US006675475B2

(12) United States Patent
Sugiura et al.

(10) Patent No.: US 6,675,475 B2
(45) Date of Patent: Jan. 13, 2004

(54) METHOD OF PRODUCING SHOE FOR SWASH PLATE TYPE COMPRESSOR

(75) Inventors: Manabu Sugiura, Kariya (JP); Takahiro Sugioka, Kariya (JP); Akira Onoda, Kariya (JP); Tomohiro Murakami, Kariya (JP); Shino Ohkubo, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 47 days.

(21) Appl. No.: 10/142,505

(22) Filed: May 9, 2002

(65) Prior Publication Data

US 2002/0166611 A1 Nov. 14, 2002

(30) Foreign Application Priority Data

May 10, 2001 (JP) ..... 2001-139540

(51) Int. Cl.[7] ..... B23D 15/00

(52) U.S. Cl. ..... 29/888.022; 29/888.02; 148/693

(58) Field of Search ..... 29/888.022, 888.02; 148/693; 92/71; 417/289; 72/356

(56) References Cited

U.S. PATENT DOCUMENTS 4,435,482 A * 3/1984 Futamura et al. ..... 428/553
5,076,089 A * 12/1991 Takami ..... 72/356
5,875,702 A * 3/1999 Kawagoe et al. ..... 92/12.2
5,896,803 A * 4/1999 Sugawara et al. ..... 92/12.2
5,950,480 A * 9/1999 Fukushima ..... 72/336
6,024,010 A * 2/2000 Kato et al. ..... 92/71
6,318,236 B1 11/2001 Miyazawa et al. ..... 92/12.2
2002/0092151 A1 * 7/2002 Sugiura et al. ..... 29/527.6
2002/0170425 A1 * 11/2002 Tarutani et al. ..... 92/70
2002/0189316 A1 * 12/2002 Tomita et al. ..... 72/356
2003/0088979 A1 * 5/2003 Tomita et al. ..... 29/888.02

FOREIGN PATENT DOCUMENTS

JP 10-169559 6/1998 ..... F04B/39/00

* cited by examiner

*Primary Examiner*—I Cuda-Rosenbaum
(74) *Attorney, Agent, or Firm*—Morgan & Finnegan, LLP

(57) ABSTRACT

A method of producing a shoe for a swash plate type compressor, the shoe being disposed between a swash plate and a piston of the swash plate type compressor and formed of an aluminum alloy, the method comprising: a main forging step of forging a blank for producing the shoe into a roughly-shaped precursor shoe; a thermal refining step of thermally refining the roughly-shaped precursor shoe; and a size-adjustment forging step of forging the roughly-shaped precursor shoe which has been thermally refined, into a size-adjusted shoe.

15 Claims, 8 Drawing Sheets

METHOD OF PRODUCING SHOE FOR SWASH PLATE TYPE COMPRESSOR

This application is based on Japanese Patent Application No. 2001-139540 filed May 10, 2001, the contents of which are incorporated hereinto by reference.

BACKGROUND OF THE INVENTION

1. Field of the Invention

The present invention relates in general to a method of producing a shoe which is formed of an aluminum alloy and which is disposed between a swash plate and a piston of a swash plate type compressor.

2. Discussion of the Related Art

A swash plate type compressor is adapted to compress a gas by converting a rotary movement of the swash plate into a reciprocating movement of a plurality of pistons. Between the swash plate which is rotated at a relatively high speed and each piston which is reciprocated at a relatively high speed, a shoe as a sliding member is disposed for permitting a smooth relative movement therebetween. In the swash plate type compressor which is required to have a reduced weight for use in an air conditioning system of an automotive vehicle, for instance, it has been proposed to use a shoe formed of an aluminum alloy.

The shoe formed of the aluminum alloy is produced, for instance, by a method comprising: a forging step of forging a blank into a shoe; a thermal refining step of thermally refining the shoe according to a T6 or a T7 treatment specified in the Japanese Industry Standard (JIS) H0001; and a grinding step of grinding the shoe to adjust its size, so that the shoe has desired dimensions. The shoe has sliding surfaces which are to be held in sliding contact with the swash plate and the piston, respectively. In operation, the shoe slides on both of the swash plate and the piston with lubricant oil films being formed between the sliding surfaces of the shoe and the sliding surfaces of the swash plate and the piston. Accordingly, suitable clearances need to be formed between the sliding surfaces of the shoe and the sliding surfaces of the swash plate and the piston. Therefore, the shoe is required to have a high degree of dimensional accuracy.

In the thermal refining treatment such as the T6 or T7 treatment, the shoe is subjected to heating, rapid cooling, etc., so that the shoe inevitably suffers from deformation due to the thermal refining treatment. Since some variation in the amount of deformation of the shoe due to the thermal refining treatment is inevitable, however, the forging operation in the forging step is arranged such that the shoe obtained after the forging step has a size which is larger than a nominal or desired value. In the grinding step following the thermal refining step, the grinding operation is effected on the shoe for adjusting its size to the nominal value. In the size-adjustment grinding operation, however, the required amount of stock removal is inevitably large, resulting in an increase of the time required for adjusting the size of the shoe after the thermal refining step and an increase of the cost of its manufacture.

SUMMARY OF THE INVENTION

It is therefore an object of the present invention to provide a method of quickly and economically producing a shoe formed of an aluminum alloy and having a high degree of dimensional accuracy. This object may be achieved according to any one of the following modes of the present invention, each of which is numbered like the appended claims and depends from the other mode or modes, where appropriate, to indicate and clarify possible combinations of elements or technical features of the present invention, for easier understanding of the invention. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) A method of producing a shoe for a swash plate type compressor, the shoe being disposed between a swash plate and a piston of the swash plate type compressor and formed of an aluminum alloy, the method comprising: a main forging step of forging a blank for producing the shoe into a roughly-shaped precursor shoe; a thermal refining step of thermally refining the roughly-shaped precursor shoe; and a size-adjustment forging step of forging the roughly-shaped precursor shoe which has been thermally refined, into a size-adjusted shoe.

The method of producing a shoe according to the above mode (1) is characterized by conducting an additional or a supplemental forging operation to adjust the size of the roughly-shaped precursor shoe obtained after the main forging step and the thermal refining step. The shoe is inevitably deformed due to the thermal refining treatment in the thermal refining step, and the amount of deformation of the shoe due to the thermal refining treatment varies depending upon individual shoes. In the present method according to the above mode (1), the roughly-shaped precursor shoe which has been thermally refined is subjected to the additional forging operation for size-adjustment, for thereby permitting the obtained shoe to have a high degree of dimensional accuracy. Since the forging operation can be generally effected in a relatively short period of time, the size-adjustment forging step according to the above mode (1) of the present invention can be quickly effected without considerably increasing the time required for producing the shoe. Accordingly, the present method according to the above mode (1) permits an economical manufacture of the shoe.

The aluminum alloy used for producing the shoe is not particularly limited, but may be selected from among aluminum alloys conventionally used for producing the shoe and various known aluminum alloys. For example, it is possible to use an Al—Si alloy having a ratio of content of Al to Si which is nearly equal to that at which an eutectic mixture is formed. The Al—Si alloy is, for instance, A4032 specified in JIS H4100. The Al—Si alloy has a small coefficient of thermal expansion and exhibits a good wear resistance, so that the shoe formed of the Al—Si alloy exhibits good sliding characteristics. It is possible to use an Al—Cu—Mg alloy such as A2017, A2024 specified in JIS H4100, which alloy has a high degree of strength. The shoe formed of the Al—Cu—Mg alloy exhibits high degrees of strength and durability.

The shape of the blank used in the main forging step is not particularly limited, but may be suitably determined depending upon the shape of the shoe to be obtained. For instance, the blank may have a spherical shape, a hemi-spherical shape, a cylindrical shape, a disc-like shape, a truncated conic shape, or a truncated pyramid shape. Where the shoe has a part-spherical crown shape which will be described, it is desirable to use a cylindrical blank having a diameter which is smaller than an outer diameter of the shoe as the end product (hereinafter referred to as "end product shoe") and a height which is larger than that of the end product shoe, for permitting a forging operation at a relatively low forging ratio. The blank may be prepared according to any methods. For example, the blank is prepared by casting, punching of a plate member by a press, or cutting of a long cylindrical member. Where the blank has the cylindrical shape described above, the cylindrical blank is prepared first by extruding a billet having a predetermined shape and formed of an aluminum alloy which is obtained by casting and which has a predetermined composition, drawing the billet to provide a bar-shaped member having a predetermined diameter, and then cutting, by a shearing machine or a sawing machine, the bar-shaped member into pieces each having a predetermined length. The blank to be used in the main forging step is desirably subjected to an annealing treatment for facilitating the forging operation performed on the blank in the main forging step and obtaining a roughly-shaped precursor shoe which has good characteristics, e.g., a high degree of dimensional accuracy. The annealing condition varies depending upon the kind of the aluminum alloy of the blank. For annealing the blank, the blank is kept at a temperature of about 300–420° C. for a predetermined time and then subjected to a slow-cooling such as an air-cooling or a furnace-cooling, for instance.

Each of the main forging step and the size-adjustment forging step may be effected in a hot or a cold state. Where the forging ratio is relatively high, the hot forging is preferably employed to prevent cracking on the surface of the shoe. Where the forging ratio is relatively low, the cold forging is preferably employed. The article obtained by the cold forging has a high degree of dimensional accuracy and a good surface condition. Further, the cold forging can be effected in a simplified and economical manner without heating. In the main forging step and the size-adjustment forging step, it is preferable to employ a closed-die forging operation which causes a plastic flow within the cavity of the die assembly, rather than a free forging operation, for permitting the forged article to have a high degree of accuracy in configuration and dimensions.

The thermal refining step is effected for the purpose of increasing a strength and a hardness of the shoe formed of the aluminum alloy, for instance. The thermal refining treatment conducted in the thermal refining step includes, for instance, a T4 treatment in which the roughly-shaped precursor shoe is subjected to natural aging by effecting a solution heat treatment, a T6 treatment in which the roughly-shaped precursor shoe is subjected to an artificial age hardening treatment after it has been subjected to the solution heat treatment, and a T7 treatment in which the roughly-shaped precursor shoe is subjected to a stabilizing treatment which will be described, after it has been subjected to the solution heat treatment. The strength and hardness of the shoe are considerably increased by the thermal refining treatment. The T4, T6, and T7 treatments are specified in JIS H0001.

The configuration of the size-adjusted shoe is not necessarily the same as that of the end product shoe which is installed on the swash plate type compressor. The size-adjusted shoe obtained after the size-adjusting forging step may be subjected to a surface treatment such as an electroless nickel plating. In this case, strictly speaking, the configuration of the size-adjusted shoe is not the same as that of the end product shoe which has been subjected to the surface treatment. Namely, the configuration of the size-adjusted shoe refers to a configuration of a base body formed of the aluminum alloy, which base body constitutes a substantial portion of the shoe and does not include a coating film or layer to be formed on its surface. The size-adjusted shoe may be subjected to a grinding operation for considerably small size-adjustment after the size-adjusting forging step. In this case, strictly speaking, the configuration of the base body of the size-adjusted shoe is not the same as that of the base body of the end product shoe which has been subjected to the size-adjusting grinding operation. The object of the method according to the present mode is to permit a quick size-adjustment operation by grinding, for instance, for thereby reducing the cost of the manufacturing of the shoe. As long as the object is attained, the slight difference between the configuration of the size-adjusted shoe obtained after the size-adjustment forging step and the configuration of the end product shoe to be installed on the compressor is not material in practicing the present method. The configuration of the size-adjusted shoe is considerably similar to that of the base body of the end product shoe installed on the compressor.

The roughly-shaped precursor shoe according to the above mode (1) has a higher similarity in configuration to the size-adjusted shoe than the blank. In the present method, the blank is forged, in the main forging step, into the roughly-shaped precursor shoe having a configuration which is very similar to that of the size-adjusted shoe, and the roughly-shaped precursor shoe obtained in the main forging step is subjected, after the thermal refining step, to the size-adjustment forging step wherein the forging ratio is lower than that in the main forging step. Namely, in the size-adjustment forging step, the rest of the forging operation is effected on the roughly-shaped precursor shoe to provide the size-adjusted shoe. Since the strength and the hardness of the shoe are increased after the shoe has been subjected to the thermal refining treatment, it will be difficult to effect, on the shoe, a forging operation in which the forging ratio is relatively high, where the cold forging is employed in the size-adjustment forging step. In view of this, the present method according to the above mode (1) is efficient. In the main forging step, a substantial part of the shoe is formed. The size-adjustment forging step can be referred to as "sizing forging" step.

The forging ratio of the roughly-shaped precursor shoe with respect to the size-adjusted shoe is defined as follows. Where the shoe is produced from the cylindrical blank by employing, in the main forging step and the size-adjustment forging step, the closed-die forging in the cold condition, the forging ratio is defined as a ratio of the height of the roughly-shaped precursor shoe with respect to the height of the size-adjusted shoe. Where the height of the size-adjusted shoe is represented by 100%, the forging percentage of the roughly-shaped precursor shoe (100×ratio of the height of the roughly-shaped precursor shoe with respect to the height of the size-adjusted shoe) is desirably held in a range of 101–110%. If the forging percentage of the roughly-shaped precursor shoe falls within the specified range, the roughly-shaped precursor shoe can be forged, in the size-adjustment forging step, into the size-adjusted shoe with a considerably high degree of dimensional accuracy. The forging percentage of the cylindrical blank (100×ratio of the height of the cylindrical blank with respect to the height of the size-adjusted shoe) is preferably held in a range of 105–140%.

(2) A method according to the above mode (1), wherein the main forging step comprises a plurality of sub-forging steps.

Where the blank needs to be forged to a great extent or the blank needs to be forged into a complicated shape by the cold forging, in particular, it may be difficult to cause an effective plastic flow of the material within the cavity of the die assembly, resulting in a deterioration in quality (e.g., dimensional accuracy) of the article to be obtained. In this case, if the forging operation on the blank is effected in a plurality of steps using different die assemblies, the degree to which the blank is forged in each step can be made low, so that the forged article has a high degree of dimensional accuracy and is free from any defects. Accordingly, the method according to the above mode (2) wherein the main forging step comprises a plurality of sub-forging steps permits an easy manufacture of the roughly-shaped precursor shoe having good characteristics, e.g., a high degree of dimensional accuracy.

(3) A method according to the above mode (2), further comprising an annealing step effected following at least one of the plurality of sub-forging steps except a last one of the plurality of sub-forging steps.

The forged article tends to suffer from work hardening (strain hardening) when the forging ratio is high, particularly where the cold forging is employed, making the subsequent forging operation difficult. In this case, the forged article is subjected to an annealing treatment, so that the article is softened, for thereby facilitating the subsequent forging operation. The annealing treatment in the annealing step effected between successive two forging steps is referred to as an intermediate annealing. The material of the article is softened by the intermediate annealing which is effective to promote the recovering process in which the lattice defect such as dislocation caused in the prior forging operation is eliminated or rectified. Accordingly, the present method according to the above mode (3) wherein the annealing step is effected following at least one of the plurality of sub-forging steps of the main forging step permits a forging operation at a relatively high forging ratio. The condition at which the annealing treatment is effected varies depending upon the kind of the aluminum alloy. When the annealing treatment is effected in a batch type furnace, the shoe is kept at about 300–430° C. for about 2–4 hours. When the annealing treatment is effected in a continuous furnace, the shoe is kept at a temperature in the vicinity of 500° C. for several tens of seconds, and then gradually cooled.

(4) A method according to the above modes (2), wherein an annealing step is not effected between any successive two of the plurality of sub-forging steps.

If the shoe is subjected to the annealing treatment described above, it requires a certain time period for annealing. Further, the annealing treatment requires an equipment such as a heating furnace and an energy source for heating the shoe, inevitably pushing up the cost of manufacture of the shoe. In view of this, the annealing treatment is not effected to reduce the cost of manufacture of the shoe as long as the forging operation can be performed effectively without the annealing operation. Therefore, the present method according to the mode (4) permits an economical manufacture of the shoe.

(5) A method according to the above modes (2), wherein the plurality of sub-forging steps consist of a first sub-forging step which is effected on the blank for obtaining an intermediate shoe whose similarity in configuration to the size-adjusted shoe is lower than the roughly-shaped precursor shoe, and a second sub-forging step which is effected on the intermediate shoe for obtaining the roughly-shaped precursor shoe.

In the method according to the mode (5), the main forging step consists of two sub-forging steps. The main forging step would be inevitably complicated if it included a large number of sub-forging steps. It is desirable to reduce the number of the sub-forging steps, where the forging ratio is relatively low in the main forging step or where the blank has a configuration which permits a relatively easy formation into the roughly-shaped precursor shoe. Accordingly, the present method according to the above mode (5) wherein the main forging step consists of two sub-forging steps permits a relatively simple and economical production of the shoe.

The intermediate shoe according to the above mode (5) has a lower similarity in configuration to the size-adjusted shoe than the roughly-shaped precursor shoe. The forging ratio of the intermediate shoe with respect to the size-adjusted shoe is defined in the same manner as described above with respect to the mode (1). In the above mode (1), the forging ratio of the roughly-shaped precursor shoe with respect to the size-adjusted shoe is represented by the ratio of the height of the roughly-shaped precursor shoe with respect to the height of the size-adjusted shoe, where the shoe is produced from the cylindrical blank by employing, in the main forging step (i.e., the two sub-forging steps) and the size-adjustment forging step, the closed-die forging in the cold condition. Where the height of the size-adjusted shoe is represented by 100%, the forging percentage of the roughly-shaped precursor shoe (100×ratio of the height of the roughly-shaped precursor shoe with respect to the height of the size-adjusted shoe) is preferably held in the range of about 101–110% as described above while the forging percentage of the cylindrical blank (100×ratio of the height of the cylindrical blank with respect to the height of the size-adjusted shoe) is preferably held in the range of about 105–140% as described above. The forging percentage of the intermediate shoe (100×ratio of the height of the intermediate shoe with respect to the height of the size-adjusted shoe) is preferably held in a range intermediate between the above-described two ranges, namely in a range of about 105–115%.

(6) A method according to the above mode (5), further comprising an annealing step effected between the first and the second sub-forging steps for annealing the intermediate shoe.

The present method according to the mode (6) enjoys advantages as described above with respect to the above mode (3). Accordingly, the present method according to the mode (6) wherein the annealing step is effected between the first and the second sub-forging steps of the main forging step permits a forging operation at a relatively high forging ratio. The annealing condition is similar to that described above with respect to the above mode (3).

(7) A method according to the above mode (5), wherein an annealing step is not effected between the first and the second sub-forging steps.

For the same reasons described above with respect to the above mode (4), the present method according to the mode (7) wherein the annealing step is not effected between the first and the second sub-forging steps permits an economical manufacture of the shoe.

(8) A method according to any one of the above modes (1)–(7), further comprising a size-adjustment grinding step effected on the size-adjusted shoe obtained after the size-adjustment forging step.

The method according to the present invention comprises the size-adjustment forging step for improving the dimensional accuracy of the shoe. The size-adjusted shoe suffers from a considerably small variation in the finished size due to the spring-back caused in the size-adjustment forging step. The present method according to the above mode (8) wherein the size-adjustment grinding step is effected on the size-adjusted shoe obtained after the size-adjustment forging step is effective to produce the shoe which is required to have a particularly high degree of dimensional accuracy.

(9) A method according to any one of the above modes (1)–(7), wherein a size-adjustment grinding step is not effected on the size-adjusted shoe obtained after the size-adjustment forging step.

By effecting the size-adjustment forging step, the size-adjusted shoe has a dimensional accuracy which is acceptable in view of the general requirements for the shoe. If the shoe is not required to have a particularly high degree of dimensional accuracy, the shoe can be produced effectively at a low cost by the present method according to the mode (9) wherein the size-adjustment grinding step is not effected on the size-adjusted shoe.

(10) A method according to any one of the above modes (1)–(9), further comprising a partial-forming step effected on a part of the blank prior to the main forging step.

If the blank has been subjected to the partial-forming step for forming a part of the shoe prior to the main forging step, which part generally has a complicated shape, the forging operations subsequently performed in the main forging step and the size-adjustment forging step can be easily effected, resulting in an improved dimensional accuracy of the obtained shoe. The above-indicated part formed prior to the main forging step is utilized as a reference for effecting various working operations in the subsequent steps such as the main forging step and the size-adjustment forging step, resulting in an improved dimensional accuracy of the obtained shoe. In view of this, the present method according to the mode (10) wherein the main forging step is effected on the partially formed blank is advantageous. The partial-forming step is effected according to any known methods such as machining, press working, and forging. For quickly effecting the partial-forming step, it is desirable to employ the press working or the forging.

(11) A method according to any one of the above modes (1)–(10), wherein the shoe for the swash plate type compressor includes a flat portion having a generally flat surface to be held in sliding contact with the swash plate, and a part-spherical portion having a generally part-spherical surface to be held in sliding contact with the piston.

The shape of the shoe produced according to the present invention is not particularly limited. Since the shoe is disposed between the swash plate and the piston in the swash plate type compressor, the shoe generally has a part-spherical crown shape described in the mode (11). It is particularly necessary to prevent the shoe from suffering from a variation in accuracy of configuration of the flat portion and the part-spherical portion each functioning as the sliding surface, or a variation in a positional relationship between the flat portion and the part-spherical portion, in other words, the height of the shoe. Accordingly, the present method which permits the production of the shoe having a high degree of dimensional accuracy is considerably advantageous for producing the part-spherical crown shoe.

The part-spherical crown shoe having a substantially spherical surface for engagement with the piston and a substantially flat surface for engagement with the swash plate is generally called as a hemispherical shoe. The flat surface may slightly deviate from a true flat surface while the spherical surface may slightly deviate from a true spherical surface for improving the sliding characteristics. Further, in general, the size of the shoe used for the compressor of variable capacity type is smaller than a hemisphere while the size of the shoe used for the compressor of fixed capacity type is larger than the hemi-sphere. Since the part-spherical surfaces of a pair of shoes which engage opposite surfaces of the swash plate of the compressor of the variable capacity type need to be located substantially on the same spherical surface, the size of each of the pair of shoes is made smaller by an amount corresponding to a half of the thickness of the swash plate. The size of the shoe used for the compressor of fixed capacity type is made slightly larger than the hemi-sphere for preventing a reduction in the sliding surface area even when the flat surface of the shoe is worn. The term "part-spherical crown shoe" is generic to the above-indicated two types of shoes.

(12) A method according to the above mode (11), wherein the shoe for the swash plate type compressor includes a flat potion having a generally annular flat surface which is formed with a recess at a substantially central portion thereof and which is to be held in sliding contact with the swash plate, and a part-spherical portion having a generally part-spherical surface to be held in sliding contact with the piston, the recess being formed in the partial-forming step.

The flat portion of the shoe which is held in sliding contact with the swash plate is subjected to a severe operating condition since the swash plate is rotated at a relatively high speed. In view of this, the flat portion of the shoe is tapered at its radially outer portion such that there is formed a clearance having a wedge-shaped cross sectional shape between the tapered portion of the flat portion and the swash plate when the shoe engages the swash plate. This tapered portion is effective to introduce a lubricant oil between the sliding surfaces of the shoe and the swash plate. For further improving the lubricating characteristic between the sliding surfaces of the shoe and the swash plate, the flat portion of the shoe is formed with a recess at a central portion thereof for accommodating the lubricant oil. When such a recess is formed in the main forging step, the plastic flow of the material is inhibited, making it difficult to form the flat portion having a desired configuration. If the recess is formed in the above-described partial-forming step effected prior to the main forging step, the flat portion having the desired configuration can be formed in the subsequent main forging step and the size-adjustment forging step. In forging the blank into the part-spherical crown shoe, it is desirable that the blank is located at a central portion of the cavity of the die assembly. If the recess formed at the central portion of the flat portion in the partial-forming step is utilized in positioning the blank relative to the die assembly such that the blank is located at the central portion of the cavity, a uniform or isotropic plastic flow of the material is caused in the cavity, permitting an improvement in the dimensional accuracy of the shoe to be obtained. The present method according to the above mode (12) relating to the part-spherical crown shoe having the recess formed at the central portion of the flat portion enjoys the advantages described above.

(13) A method according to any one of the above modes (1)–(12), wherein each of the main forging step and the size-adjustment forging step is effected by cold forging.

As explained above, the cold forging permits the obtained article to have a high degree of dimensional accuracy and a good surface condition. Further, the cold forging can be performed in a simplified and economical manner without heating. Accordingly, the present method according to the above mode (13) wherein each of the main forging step and the size-adjustment forging step is effected by cold forging enjoys the advantages described above.

(14) A method according to any one of the above modes (1)–(13), wherein the thermal refining step effected on the roughly-shaped precursor shoe comprises: a step of effecting a solution heat treatment; and a step of effecting an artificial age hardening treatment after the step of effecting the solution heat treatment.

The thermal refining treatment performed in the thermal refining step according to the above mode (14) corresponds to a T6 treatment specified in JIS H0001. The T6 treatment is performed to permit the article to exhibit the maximum strength and hardness. In the present method according to the above mode (14) wherein the T6 treatment is employed in the thermal refining step, the shoe to be produced has considerably high degrees of strength and hardness. In the solution heat treatment according to the above mode (14), the shoe is kept in a heating furnace at about 490° C. for a time period ranging from 0.5 hour to 6 hours, and then rapidly cooled to room temperature. In the artificial age hardening treatment, the shoe is kept in the heating furnace at about 180° C. for 2–6 hours.

(15) A method according to any one of the above modes (1)–(13), wherein the thermal refining step effected on the roughly-shaped precursor shoe comprises: a step of effecting a solution heat treatment; and a step of effecting an over-aging treatment which is effected beyond conditions of an artificial age hardening treatment at which the maximum strength is obtained and which is effected after the step of effecting the solution heat treatment.

The thermal refining treatment performed in the thermal refining step according to the above mode (15) corresponds to a T7 treatment specified in JIS H0001. The dimensional stability of the shoe which has been subjected to the T7 treatment is improved though the strength and hardness of the shoe are slightly lowered. Therefore, the present method according to the above mode (15) permits the production of the shoe which exhibits a high degree of stable dimensional accuracy. In the solution heat treatment according to the above mode (15), the shoe is kept in the heating furnace at about 490° C. for a time period ranging from 0.5 hour to 6 hours, and then rapidly cooled to room temperature. In the over-aging treatment, the shoe is kept in the heating furnace at about 200° C. for 3–6 hours. The over-aging treatment according to the mode (15) is also referred to as "a stabilizing treatment". In this specification, the term "stabilizing treatment" is used.

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of this invention as applied to a shoe installed on a swash plate type compressor used for an air conditioning system of an automotive vehicle. In the following description, the structure of the swash plate type compressor, the configuration and structure of the shoe, and the method of producing the shoe are explained in this order.

Figure 1:
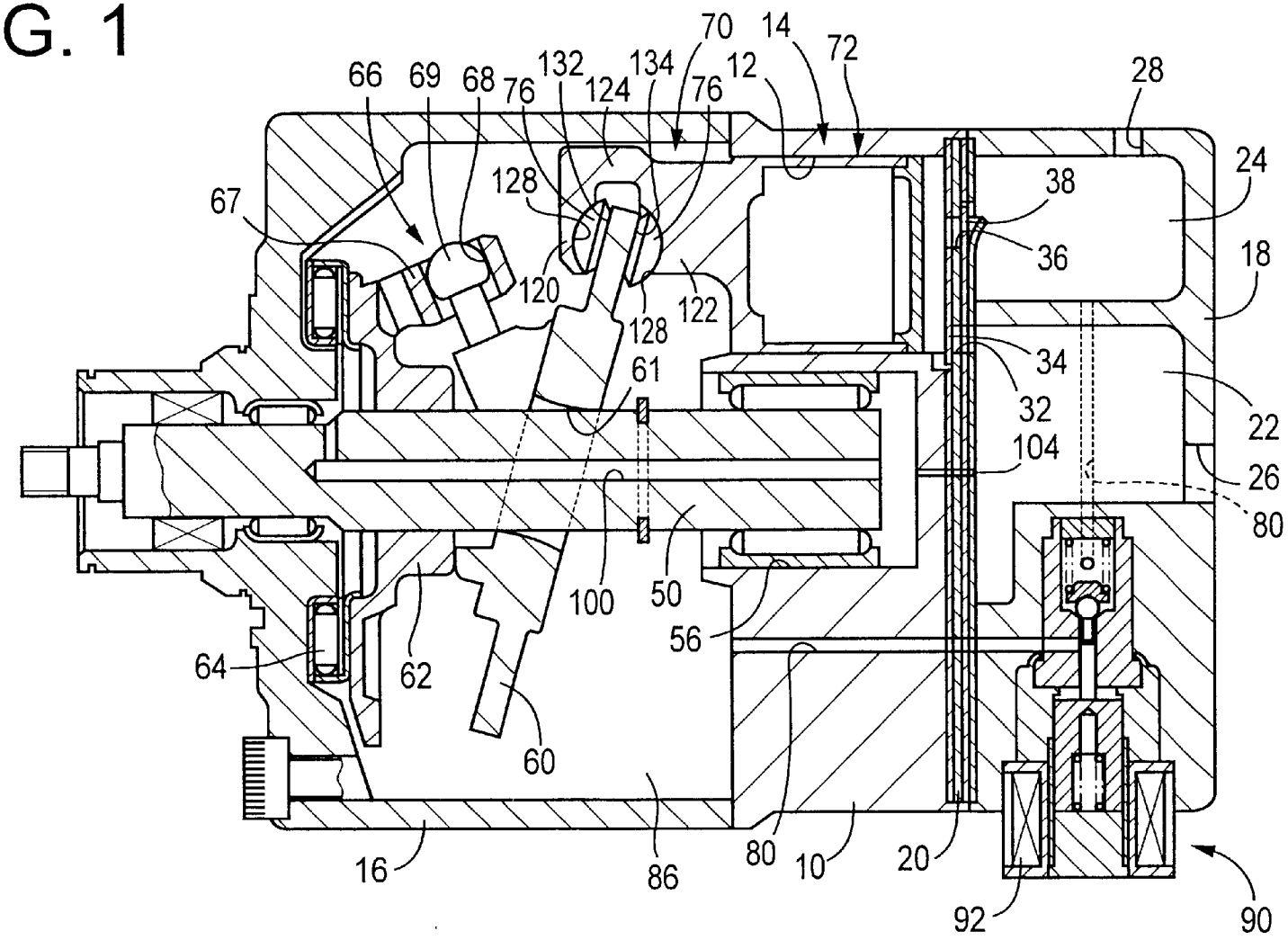
FIG. 1 is a front elevational view in cross section of a swash plate type compressor equipped with the shoe to which the principle of the present invention is applied.

Referring first to FIG. 1, there is shown a compressor of swash plate type on which the shoe produced according to the present invention is installed. In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. Single-headed pistons generally indicated at 14 (hereinafter simply referred to as "piston 14") are reciprocably received in the respective cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation of the drive shaft 50 is aligned with the centerline of the cylinder block 10. The drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis.

The rotary drive shaft 50 carries a swash plate 60 such that the swash plate 60 is axially movable and tiltable relative to the drive shaft 50. The swash plate 60 has a central hole 61 through which the drive shaft 50 extends. The inner dimension of the central hole 61 as measured in a vertical direction of FIG. 1 gradually increases in a direction from the axially intermediate portion toward each of the axially opposite ends, and the transverse cross sectional shape of the central hole 61 at each of the axially opposite ends is elongated. To the drive shaft 50, there is fixed a rotary member 62 as a torque transmitting member, which is held in engagement with the front housing 16 through a thrust bearing 64. The swash plate 60 is rotated with the drive shaft 50 by a hinge mechanism 66 during rotation of the drive shaft 50. The hinge mechanism 66 guides the swash plate 60 for its axial and tilting motions. The hinge mechanism 66 includes a pair of support arms 67 fixed to the rotary member 62, guide pins 69 which are formed on the swash plate 60 and which slidably engage guide holes 68 formed in the support arms 67, the central hole 61 of the swash plate 60, and the outer circumferential surface of the drive shaft 50.

The piston 14 indicated above includes an engaging portion 70 engaging the radially outer portion of the opposite surfaces of the swash plate 60, and a head portion 72 formed integrally with the engaging portion 70 and fitted in the corresponding cylinder bore 12. The head portion 72 in the present embodiment is made hollow, for thereby reducing the weight of the piston 14. The head portion 72, cylinder bore 12, and valve plate 20 cooperate with one another to define a pressurizing chamber. The engaging portion 70 engages the radially outer portion of the opposite surfaces of the swash plate 60 through a pair of part-spherical crown shoes 76. The shoes 76 will be described in greater detail.

A rotary motion of the swash plate 60 is converted into a reciprocating linear motion of the piston 14 through the shoes 76. A refrigerant gas in the suction chamber 22 is sucked into the pressurizing chamber of the cylinder bore 12 through the suction port 32 and the suction valve 34, when the piston 14 is moved from its upper dead point to its lower dead point, that is, when the piston 14 is in the suction stroke. The refrigerant gas in the pressurizing chamber is pressurized by the piston 14 when the piston 14 is moved from its lower dead point to its upper dead point, that is, when the piston 14 is in the compression stroke. The pressurized refrigerant gas in the pressurizing chamber is discharged into the discharge chamber 24 through the discharge port 36 and the discharge valve 38. A reaction force acts on the piston 14 in the axial direction as a result of compression of the refrigerant gas in the pressurizing chamber. This compression reaction force is received by the front housing 16 through the piston 14, swash plate 60, rotary member 62 and thrust bearing 64.

The cylinder block 10 has an intake passage 80 formed therethrough for communication between the discharge chamber 24 and a crank chamber 86 which is defined between the front housing 16 and the cylinder block 10. The intake passage 80 is connected to a solenoid-operated control valve 90 provided to control the pressure in the crank chamber 86. The solenoid-operated control valve 90 includes a solenoid coil 92. The amount of electric current applied to the solenoid coil 92 is controlled depending upon the air conditioner load by a control device not shown constituted principally by a computer.

The rotary drive shaft 50 has a bleeding passage 100 formed therethrough. The bleeding passage 100 is open at one of its opposite ends to the central bearing hole 56, and is open at the other end to the crank chamber 86. The central bearing hole 56 communicates at its bottom with the suction chamber 22 through a communication port 104.

The present swash plate type compressor is of variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the pressurizing chamber and the pressure in the crank chamber 86 is regulated to change the angle of inclination of the swash plate 60 with respect to a plane perpendicular to the axis of rotation of the drive shaft 50, for thereby changing the reciprocating stroke (suction and compression strokes) of the piston 14, whereby the displacement capacity of the compressor can be adjusted. Described in detail, by energization and de-energization of the solenoid coil 92 of the solenoid-operated control valve 90, the crank chamber 86 is selectively connected to and disconnected from the discharge chamber 24, so that the pressure in the crank chamber 86 is controlled.

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. Other materials may be used for the cylinder block 10, the piston 14, and the coating film.

The end portion of the engaging portion 70 of the piston 14, which is remote from the head portion 72, has a U-shape in cross section. Described in detail, the engaging portion 70 has a base section 124 which defines the bottom of the U-shape, and a pair of substantially parallel arm sections 120, 122 which extend from the base section 124 in a direction perpendicular to the axis of the piston 14. The two opposed lateral walls of the U-shape of the engaging portion 70 have respective recesses 128 which are opposed to each other. Each of these recesses 128 is defined by a part-spherical inner surface of the lateral wall. The part-spherical inner surfaces of the recesses 128 are located on the same spherical surface.

The base body of the swash plate 60 which engages the shoes 76 is formed of spheroidal graphite cast iron, generally called as ductile cast iron (FCD 700) specified in the JIS G5502. The swash plate 60 includes sliding surfaces 132, 134 which are to be held in sliding contact with the shoes 76. At each portion of the base body of the swash plate 60 providing each of the sliding surfaces 132, 134, an aluminum sprayed film and a lubricating film are formed in this order. The lubricating film is formed of a synthetic resin in which $MoS_2$ and graphite are dispersed. The lubricating film is effective to improve the sliding characteristics of the swash plate 60 and the shoe 76 by reducing the friction between the sliding surfaces of the swash plate 60 and the shoe 76. The aluminum sprayed film is effective to maintain good sliding characteristics while preventing a direct contact of the base body of the swash plate 60 with the shoe 76 even when the lubricating film is removed or separated due to wear, for instance.

Figure 2:
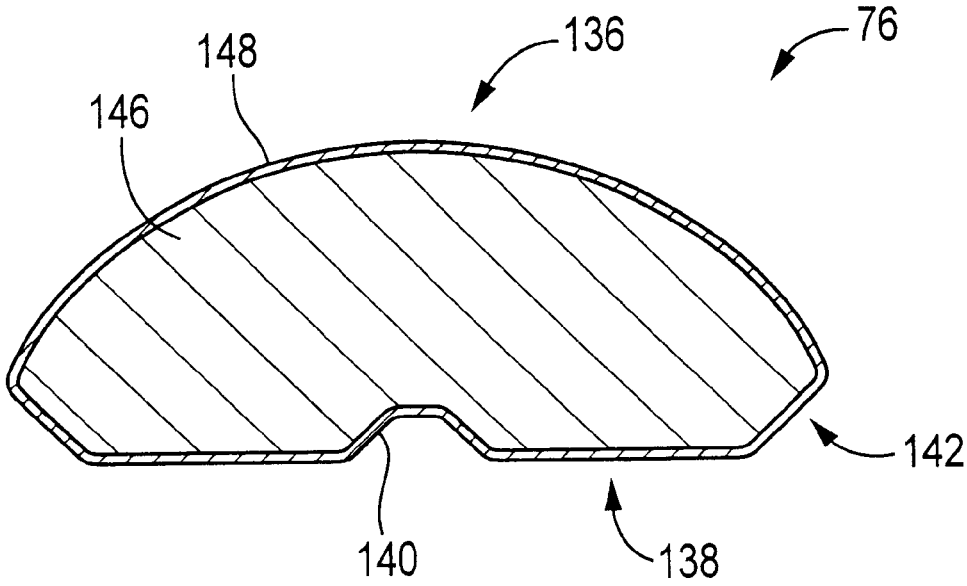
FIG. 2 is a front elevational view in cross section of the shoe of FIG. 1.

As shown in FIG. 2, each of the pair of shoes 76 has a part-spherical crown shape, and includes a part-spherical portion 136 having a generally convex part-spherical surface and a flat portion 138 having a generally flat surface. Strictly speaking, the flat portion 138 is a curved surface which is slightly convex (e.g., a convex part-spherical surface having a considerably large radius of curvature), and has a recess 140 formed at its central portion for accommodating a lubricant oil to assure good sliding characteristics of the shoe 76 with respect to the swash plate 60. Accordingly, the flat portion 138 provides an annular sliding surface which is to be held in sliding contact with the swash plate 60. Between the part-spherical portion 136 and the flat portion 138, there is formed a tapered portion 142 having a tapered surface (a circumferential surface of a truncated cone) which has a predetermined angle with respect to the flat surface of the flat portion 138. The tapered portion 142 is effective to introduce the lubricant oil between the sliding surfaces 132, 134 of the swash plate 60 and the flat portion 138 of each of the pair of shoes 76 when the shoes 76 slidably engage the swash plate 60. The boundary between the flat surface of the flat portion 138 and the tapered surface of the tapered portion 142, and the boundary between the tapered surface of the tapered portion 142 and the convex part-spherical surface of the part-spherical portion 136 are rounded so as to have respective different small radii of curvature. The pair of shoes 76 slidably engage the part-spherical inner surfaces of the recesses 128 of the piston 14 at their part-spherical portions 136 and slidably engage the radially outer portion of the opposite surfaces of the swash plate 60, i.e., the sliding surfaces 132, 134, at their flat portions 138., In other words, the pair of shoes 76 slide on the swash plate 60 and the piston 14 at their flat portions 138 and part-spherical portions 136, respectively. The pair of shoes 76 are designed such that the convex part-spherical surfaces of the part-spherical portions 136 are located on the same spherical surface. In other words, each shoe 76 has a part-spherical crown shape whose size is smaller than a hemi-sphere by an amount corresponding to a half of the thickness of the swash plate 60.

The shoe 76 includes a base body 146 and a metal plating film 148 which is formed so as to cover the surface of the base body 146. In FIG. 2, the thickness of the metal plating film 148 is exaggerated for easier understanding. The base body 146 is formed of an Al—Si alloy (A4032) whose major component is aluminum and which has a ratio of content of Al to Si substantially equal to that at which the eutectic mixture is formed. Various kinds of aluminum alloy can be used for the material of the base body of the present shoe. The metal plating film 148 in the present embodiment is an electroless nickel plating film which exhibits high degrees of hardness and strength, for thereby preventing the wear of the shoe 76 while protecting the shoe 76 from being damaged or scratched. The electroless nickel plating may be Ni—P plating, Ni—B plating, or Ni—P—B—W plating. The shoe may not have the metal plating film 148. The kind of the metal plating film is not particularly limited. Further, the metal plating film may consist of a single film or a plurality of the same kind of or different kinds of films. The metal plating film may cover the entire surface or a portion of the base body. In place of or in addition to the electroless nickel plating film, other metal plating films such as electroless cobalt plating including Co—P plating, and hard chrome plating can be employed. The metal plating film 148 may be covered with a lubricating film which contains a solid lubricant.

Figure 3:
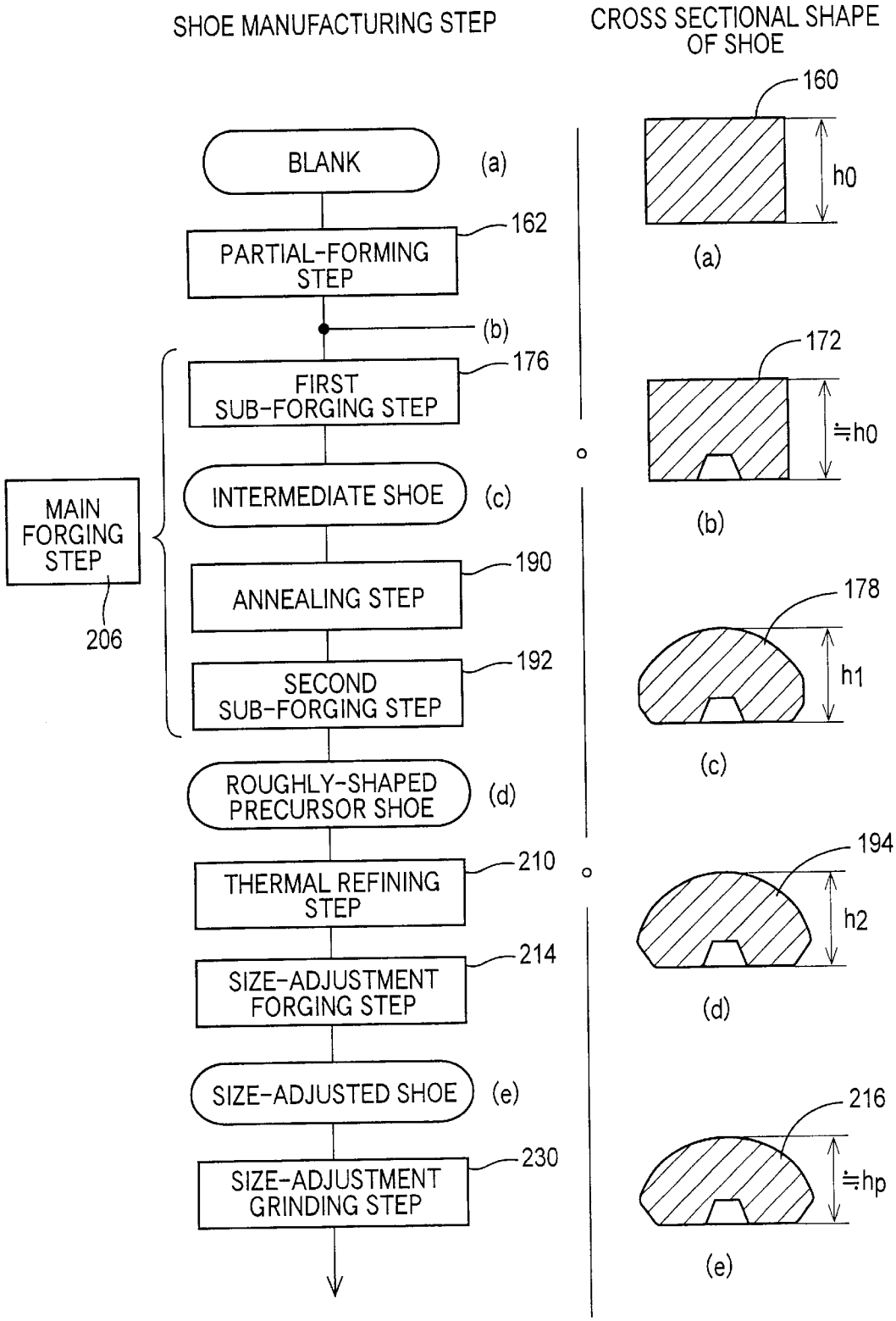
FIG. 3 is a flow chart showing process steps for producing the shoe according to one embodiment of the invention, together with the cross sectional shapes of the shoe in some of the process steps.

There will be next explained a method of producing the shoe by referring to the flow chart of FIG. 3. As shown in FIG. 3, the shoe has respective different cross sectional shapes at the different timings indicated by (a) through (e) in the flow chart.

The shoe 76 is produced from a cylindrical blank 160. (In a strict sense, the base body 146 of the shoe is produced. For easier understanding, however, the term "shoe" is used in the following description.) The blank 160 is formed of the above-described Al—Si alloy (A4032), and has an outer diameter smaller than that of the shoe 76 and a height larger than that of the shoe 76. The cylindrical blank 160 is prepared first by extruding a billet formed of an aluminum alloy which is obtained by casting and which has a predetermined composition, drawing the billet to provide a bar-shaped member having a predetermined diameter, annealing the bar-shaped member, and then cutting, by a sawing machine, the bar-shaped member into pieces each having a predetermined length. The obtained blank 160 is subjected to barrel polishing, so that the surface of the blank is smoothed. Where the forging ratio is low or the surface of the blank cut by the sawing machine is sufficiently smooth, the barrel polishing may be eliminated for reducing the manufacturing cost of the shoe 76. The forging ratio of the shoe at a point in the process steps is represented by a height of the shoe at that point to a height $h_p$ of the shoe 76 (i.e., a height as the designed value). Where the height of the blank 160 is $h_0$, the forging ratio of the blank 160 with respect to the shoe 76 is about 1.2, i.e., the forging percentage $h_0/h_p$ is about 120%, in the present embodiment.

Figure 4:
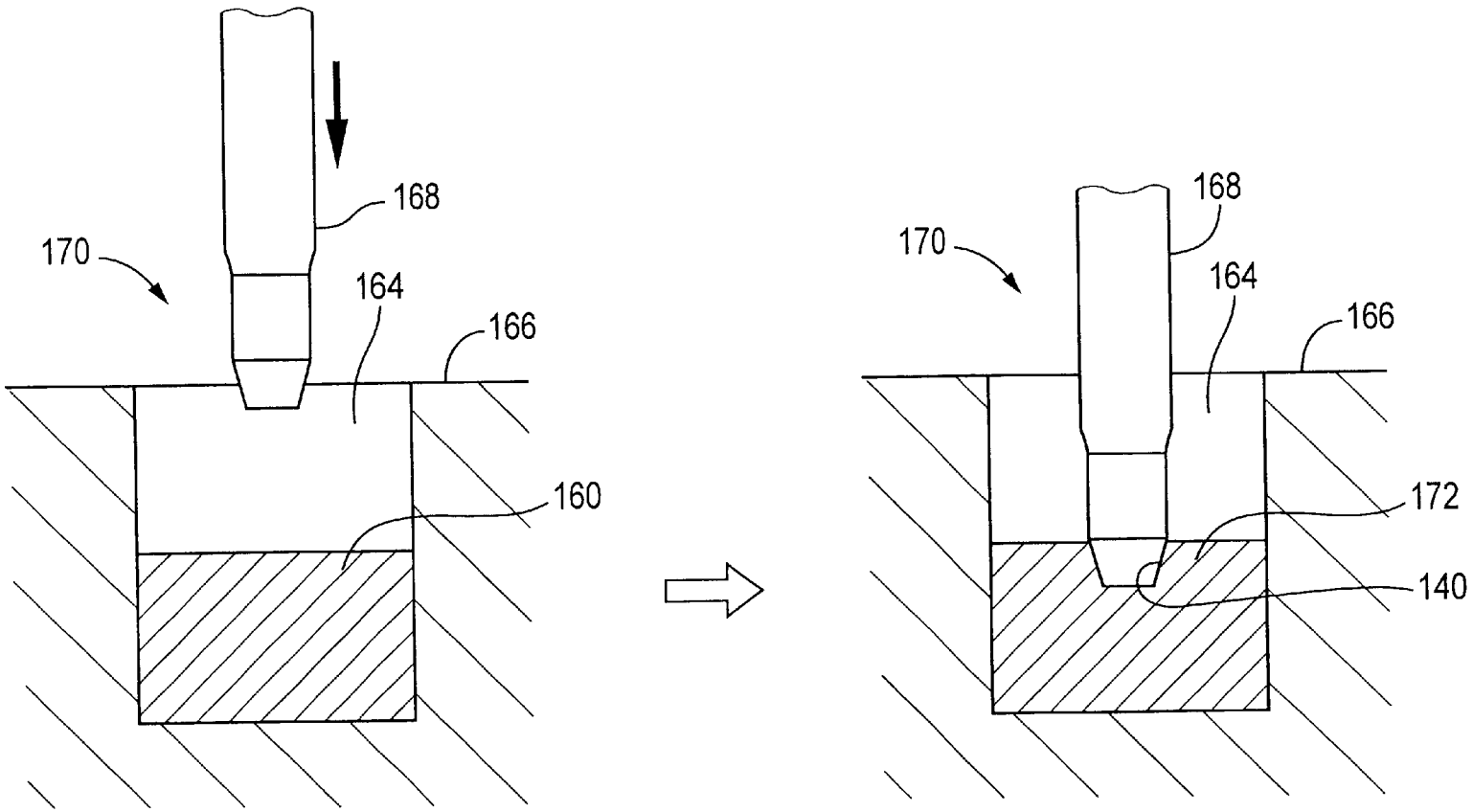
FIG. 4 is a front elevational view in cross section schematically showing the partial-forming step.

The blank 160 prepared as described above is subjected to a partial-forming operation in a partial-forming step 162 for forming a part of the shoe 76, as schematically indicated in FIG. 4. Described in detail, the recess 140 of the flat portion 138 of the shoe 76 is formed in the partial-forming step 162. As shown in FIG. 4, the partial-forming operation is effected by a press which includes a die set 170. The die set 170 includes a lower die 166 and a punch 168. The lower die 166 has a cylindrical hole whose inner diameter is substantially equal to the outer diameter of the blank 160 and whose depth is larger than the height of the blank 160. The punch 168 is inserted into the cylindrical hole of the lower die 166. Initially, the blank 160 is positioned in the cylindrical hole 164. Then, the punch 168 is pressed onto the blank 160 and is lowered to a predetermined position, so that the distal end portion of the punch 168 is inserted into the blank 160, for thereby forming the recess 140 in the blank 160. The thus obtained partially formed blank 172 has a height which is substantially equal to that of the blank 160.

Figure 5:
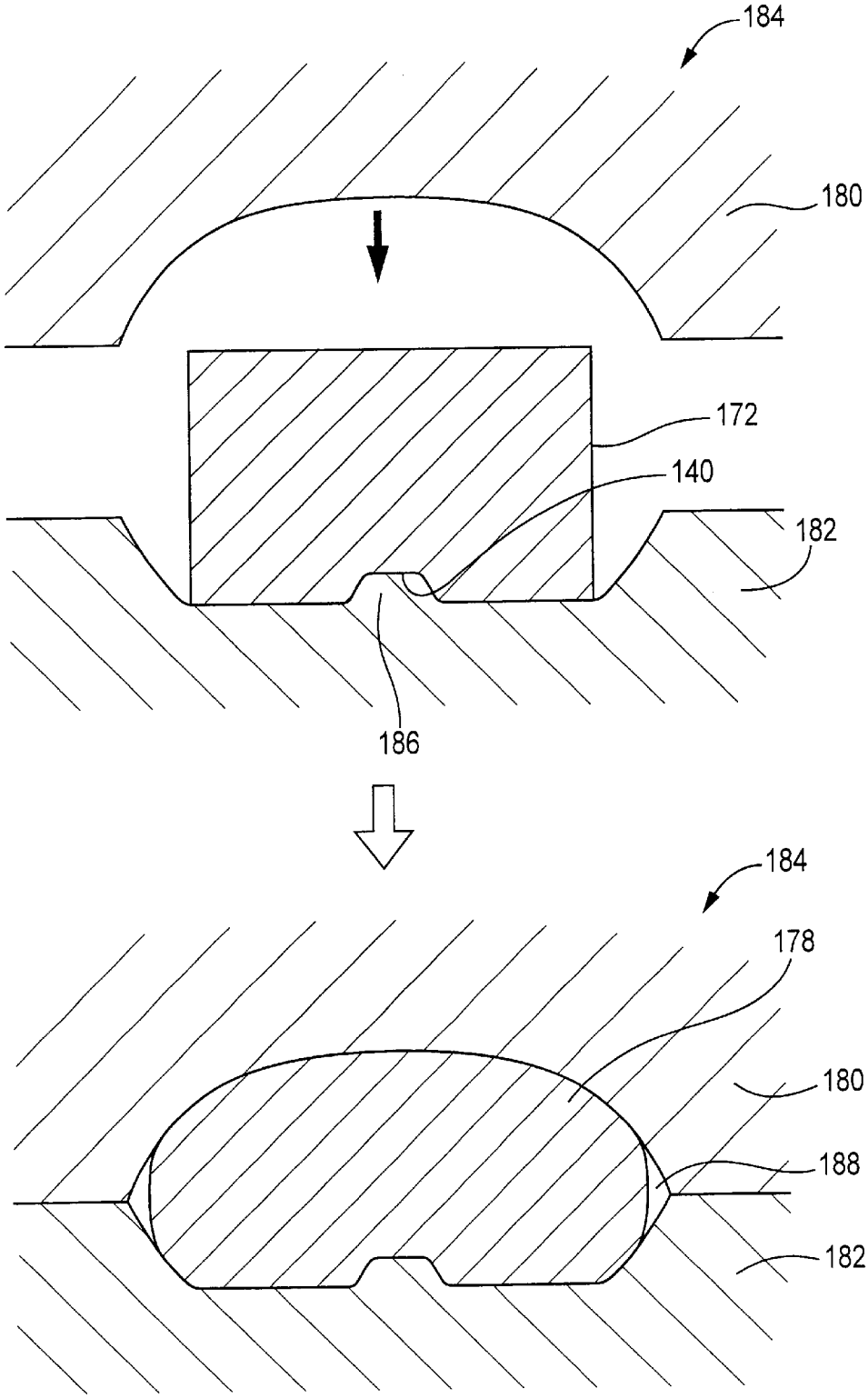
FIG. 5 is a front elevational view in cross section schematically showing the first-sub forging step.

The partially formed blank 172 is forged into an intermediate shoe 178 in a first sub-forging step 176, as schematically indicated in FIG. 5. The first sub-forging operation in the first sub-forging step 176 is effected by cold forging using a die assembly 184 consisting of an upper die 180 and a lower die 182. When the upper and lower dies 180, 182 are closed together, a cavity whose configuration is substantially the same as that of the intermediate shoe 178 is defined. At a central portion of the lower die 182, there is formed a protrusion 186 which is to be held in engagement with the recess 140 of the partially-formed blank 172 (the recess 140 of the shoe 76). The partially-formed blank 172 is positioned relative to the lower die 182 such that the protrusion 186 is fitted in the recess 140. Owing to the recess 140 which has been formed in the partial-forming step 162 prior to the forging steps, the blank 172 can be positioned in the die assembly with high accuracy, thereby optimizing a plastic flow of the material within the cavity. Accordingly, the intermediate shoe 178 to be obtained in the first sub-forging step 176 is not likely to suffer from the dimensional variation. The upper die 180 is lowered after the blank 172 has been positioned as described above, so that the upper and lower dies 180, 182 are closed together for forging the blank 172 into the intermediate shoe 178. The upper and lower dies 180, 182 are designed such that there is formed a space 188 around the radially outer portion of the intermediate shoe 178 while the two dies 180, 182 are closed. The space 188 which is not filled with the material absorbs or accommodates the variation in the amount of the material. Where the height of the intermediate shoe 178 is $h_1$, the forging ratio of the intermediate shoe 178 with respect to the shoe 76 is about 1.07, i.e., the forging percentage $h_1/h_p$ is about 107%, in the present embodiment.

The intermediate shoe 178 obtained as described above is then subjected to an annealing treatment in an annealing step 190. In the annealing treatment according to the present embodiment, the intermediate shoe 178 is kept in the heating furnace at about 415° C. for about three hours, and then gradually cooled at a cooling rate of about 25° C./hour. The annealing treatment facilitates the subsequent forging operation in a second sub-forging step described below.

Figure 6:
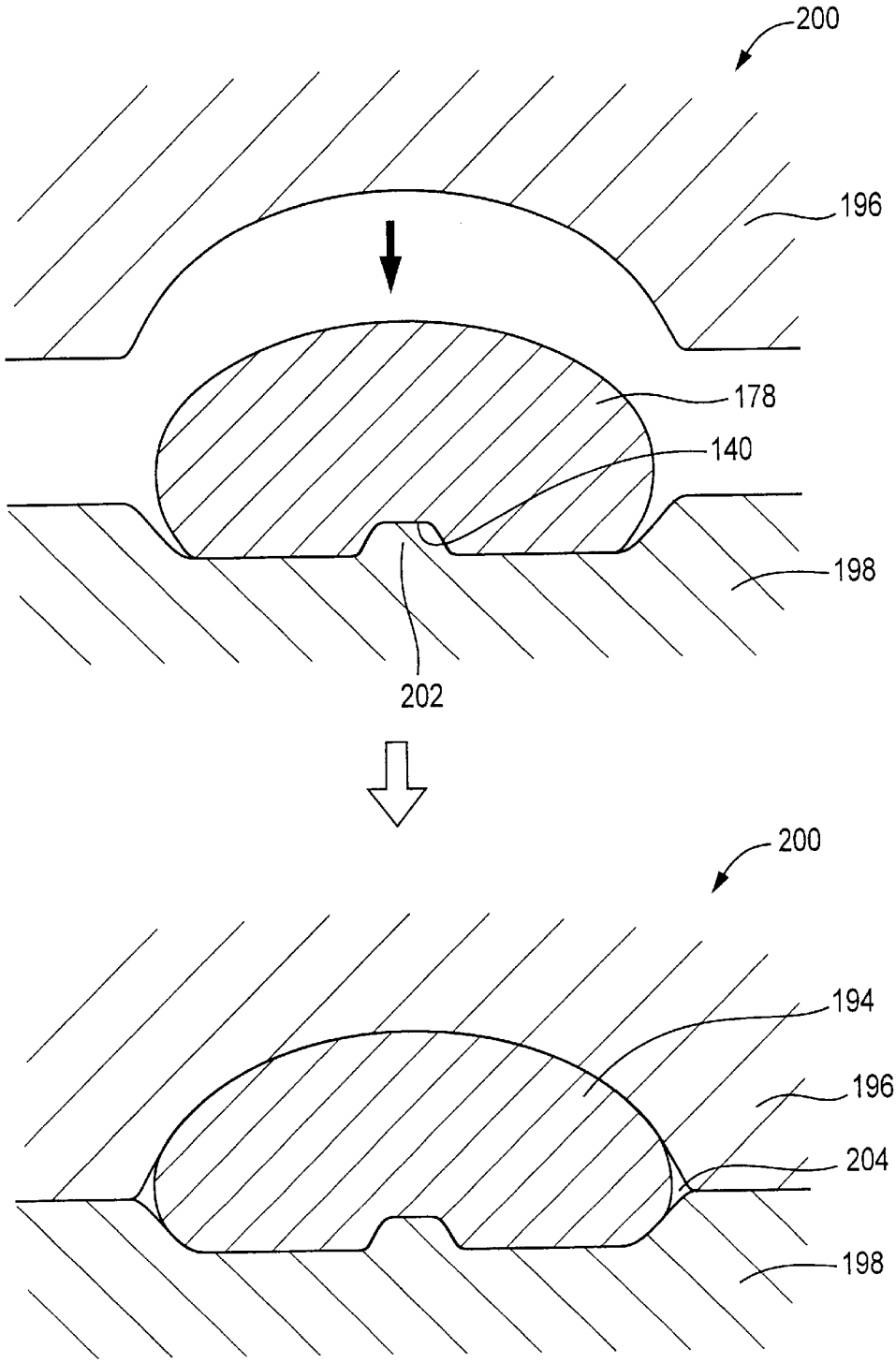
FIG. 6 is a front elevational view in cross section schematically showing the second sub-forging step.

The intermediate shoe 178 which has been subjected to the annealing treatment is forged into a roughly-shaped precursor shoe 194 in the second sub-forging step indicated at 192 in the flow chart of FIG. 3. Like the first sub-forging step 176 described above, the second sub-forging step 192 schematically shown in FIG. 6 is effected by cold forging using a die assembly 200 consisting of an upper die 196 and a lower die 198. When the upper and lower dies 196, 198 are closed together, a cavity whose configuration is substantially the same as that of the roughly-shaped precursor shoe 194 is defined. At a central portion of the lower die 198, there is formed a protrusion 202 which is similar to the protrusion 186 and which is to be held in engagement with the recess 140 of the intermediate shoe 178 (the recess 140 of the shoe 76). The intermediate shoe 178 is positioned relative to the lower die 198 such that the protrusion 202 is fitted in the recess 140. The advantage of the engagement of the protrusion 202 and the recess 140 for positioning the intermediate shoe 178 relative to the lower die 198 is the same as described above with respect to the first sub-forging step 176, and a detailed explanation of which is dispensed with. The upper die 196 is lowered after the intermediate shoe 178 has been positioned as described above, so that the upper and lower dies 196, 198 are closed together for forging the intermediate shoe 178 into the roughly-shaped precursor shoe 194. Like the upper and the lower dies 180, 182 used in the first sub-forging step 176, the upper and lower dies 196, 198 are designed such that there is formed a space 204 around the radially outer portion of the roughly-shaped precursor shoe 194 while the two dies 196, 198 are closed. Like the space 188, the space 204 which is not filled with the material absorbs or accommodates the variation in the amount of the material. Where the height of the roughly-shaped precursor shoe 194 is $h_2$, the forging ratio of the roughly-shaped precursor shoe 194 with respect to the shoe 76 is about 1.03, i.e., the forging percentage $h_2/h_p$ is about 103%, in the present embodiment. The first sub-forging step 176, annealing step 190, and second sub-forging step 192 cooperate to constitute a main forging step 206.

After the main forging step 206, i.e., after the second sub-forging step 192, the roughly-shaped precursor shoe 194 is subjected to a thermal refining treatment in a thermal refining step 210. As the thermal refining treatment performed on the roughly-shaped precursor shoe 194, the T6 treatment is employed. In the T6 treatment, the roughly-shaped precursor shoe 194 is subjected to the artificial age hardening treatment after it has been subjected to the solution heat treatment. The solution heat treatment is effected such that the roughly-shaped precursor shoe 194 is kept in the heating furnace at about 490° C. for about one hour, and then rapidly cooled to room temperature. The artificial age hardening treatment is effected such that the roughly-shaped precursor shoe 194 is kept in the heating furnace at about 180° C. for about 5 hours. In place of the T6 treatment, the T7 treatment may be effected. In the T7 treatment, the roughly-shaped precursor shoe 194 which has been subjected to the solution heat treatment is subjected to the stabilizing treatment wherein the roughly-shaped precursor shoe 194 is kept in the heating furnace at about 200° C. for about 5 hours.

Figure 7:
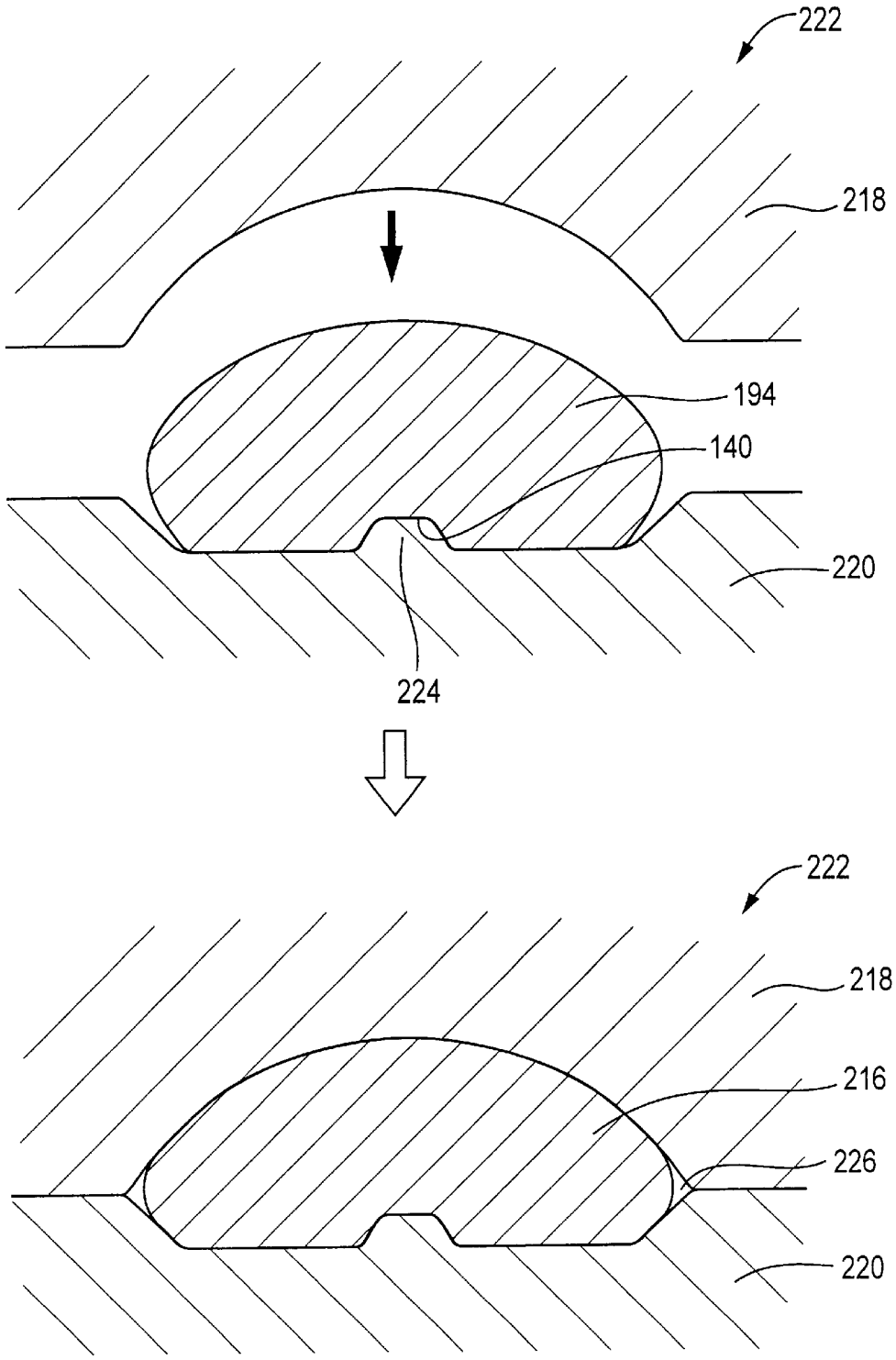
FIG. 7 is a front elevational view in cross section schematically showing the size-adjustment forging step.

The roughly-shaped precursor shoe 194 which has been subjected to the thermal refining treatment is forged into a size-adjusted shoe 216 in a size-adjustment forging step 214. Like the sub-forging steps in the main forging step 206 described above, the size-adjustment forging step 214 schematically shown in FIG. 7 is effected by cold forging using a die assembly 222 consisting of an upper die 218 and a lower die 220. When the upper and lower dies 218, 220 are closed together, a cavity whose configuration is substantially the same as that of the size-adjusted shoe 216 is defined. At a central portion of the lower die 220, there is formed a protrusion 224 which is similar to the above-described protrusions 186, 202 and which is to be held in engagement with the recess 140 of the roughly-shaped precursor shoe 194 (the recess 140 of the shoe 76). The roughly-shaped precursor shoe 194 is positioned relative to the lower die 220 such that the protrusion 224 is fitted in the recess 140. The advantage of the engagement of the protrusion 224 and the recess 140 for positioning the roughly-shaped precursor shoe 194 relative to the lower die 220 is the same as described above with respect to the first and second sub-forging steps 176, 192, and a detailed explanation of which is dispensed with. The upper die 218 is lowered after the roughly-shaped precursor shoe 194 has been positioned as described above, so that the upper and lower dies 218, 220 are closed together for forging the roughly-shaped precursor shoe 194 into the size-adjusted shoe 216. Like the upper dies 180, 196 and the lower dies 182, 198 used in the first and second sub-forging steps 176, 192, the upper and lower dies 218, 220 are designed such that there is formed a space 226 around the radially outer portion of the size-adjusted shoe 216 while the two dies 218, 220 are closed. Like the space 188, 204, the space 226 which is not filled with the material absorbs or accommodates the variation in the amount of the material.

The thus obtained size-adjusted shoe 216 is subjected to a grinding operation in the subsequent size-adjustment grinding step 230. In the present embodiment, the size-adjusted shoe 216 is subjected to surface polishing_and barrel polishing. For the purpose of grinding or polishing the flat portion 138 of the shoe 78, the surface polishing by a surface polishing machine is performed, by using free abrasive grains, on a plurality of the size-adjusted shoes 216 which are arranged in a suitable manner. The barrel polishing is performed for the purpose of grinding or polishing the entire surface of the shoe 76 including the flat portion 138, part-spherical portion 136, and tapered portion 142. The barrel polishing is effected on the size-adjusted shoes 216 which are accommodated in a barrel polishing machine together with the free abrasive grains. In the present embodiment, the shoe 76 has been forged into substantially the desired shape in the size-adjustment forging step, so that the required amount of stock removal by the grinding operation in the size-adjustment grinding step 230 can be made considerably small, resulting in a speedy grinding operation. While both of the surface polishing and the barrel polishing permit the size-adjustment of the shoe 76, the surface polishing is performed mainly for fine adjustment of the height of the shoe 76 whereas the barrel polishing is performed mainly for smoothing the surface of the shoe 76. Either one of the surface polishing and the barrel polishing is effected prior to the other.

After the sequence of the process steps has been completed, the shoe 76 is coated with the metal plating film 148 described above in a plating step. As needed, the shoe 76 is subjected to the barrel polishing and the surface polishing for making the surface of the metal plating film 148 clean and smooth. Further, the flat portion 138 is subjected to surface buffing for surface finishing, so that the intended shoe 76 is obtained. The order of the grinding or polishing operations to be effected after the plating step is not particularly limited.

The method of producing the shoe has been described by referring to the flow chart of FIG. 3. The shoe may be produced otherwise. By referring to flow charts of FIGS. 8A through 8C, there will be described some modifications of the method of producing the shoe.

Figure 8C:
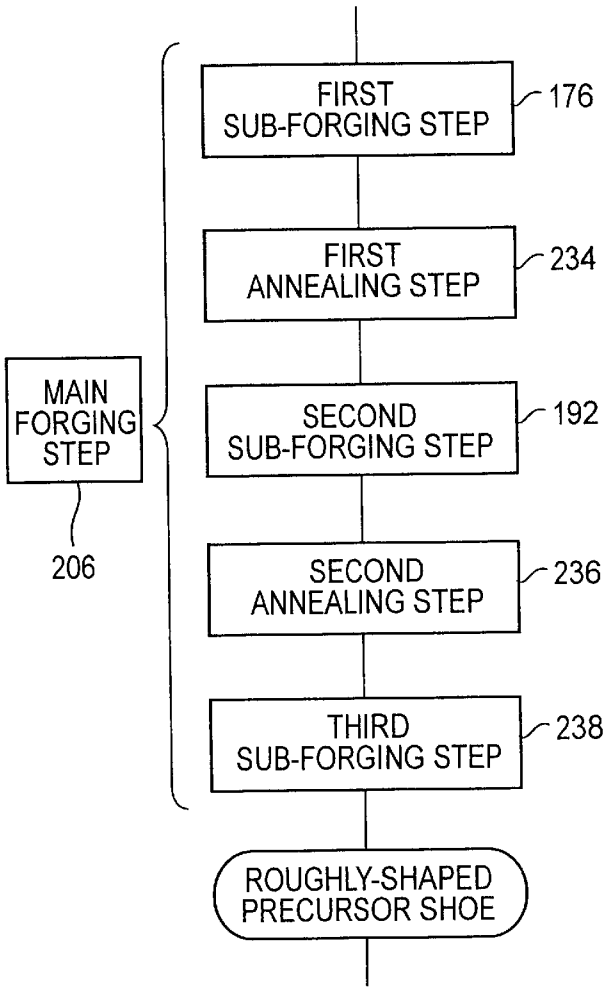
FIGS. 8A–8C show flow charts showing process steps for producing the shoe according to modified embodiments.
Figure 8B:
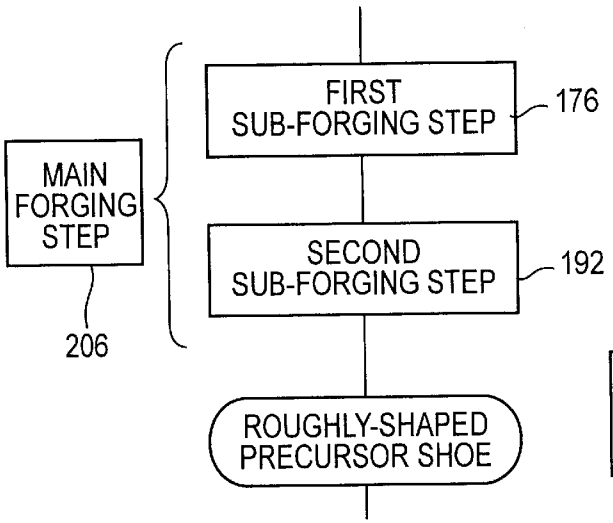
Figure 8A:
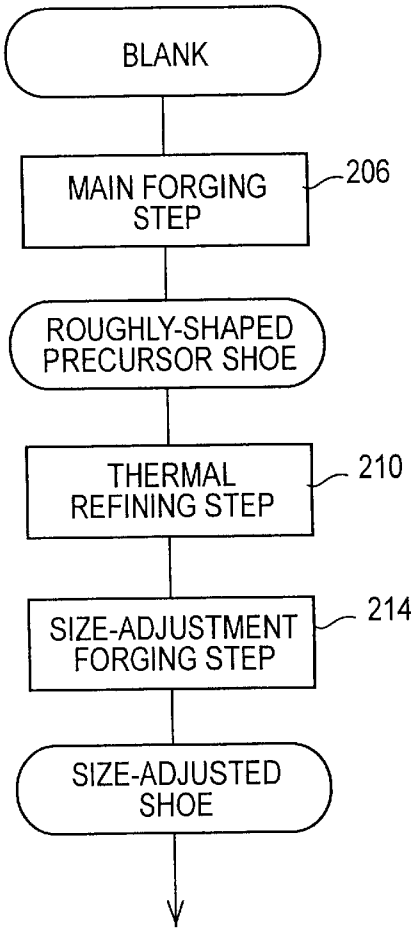

The flow chart of FIG. 8A indicates the process steps for producing the shoe according to a second embodiment of the present invention. The method according to the flow chart of FIG. 8A in the second embodiment is different from the method according to the flow chart of FIG. 3 in the first embodiment in that the partial-forming step and the size-adjustment grinding step are not effected. In other words, the method according to the second embodiment consists of the main forging step 206, thermal refining step 210, and size-adjustment forging step 214. The present method permits a speedy and economical production of the shoe in a considerably simplified manner. The method according to the flow chart of FIG. 3 may be modified such that only one of the partial-forming step and the size-adjustment grinding step is not effected.

The flow chart of FIG. 8B indicates the process steps for producing the shoe according to a third embodiment of the present invention. The method according to the flow chart of FIG. 8B in this third embodiment is the same as the method according to the flow chart of FIG. 3 in the first embodiment, except that the annealing step is not included in the main forging step 206. In other words, the main forging step 206 in the method according to the third embodiment consists of the first and second sub-forging steps 176, 192. The present method wherein the annealing step is not effected permits the production of the shoe at a reduced cost. The main forging step 206 may consist of a single forging step. In this case, the shoe can be produced more quickly and more economically.

The flow chart of FIG. 8C indicates the process steps for producing the shoe according to a fourth embodiment of the present invention. The method according to the flow chart of FIG. 8C in this fourth embodiment is the same as the method according to the flow chart of FIG. 3 in the first embodiment, except that a second annealing step 236 is effected in addition to the first annealing step 234 and that a third sub-forging step 238 is effected in addition to the first and second sub-forging steps 176, 192. In other words, the main forging step 206 of the method according to the fourth embodiment consists of the first sub-forging step 176, first annealing step 234, second sub-forging step 192, second annealing step 236, and third sub-forging step 238. The present method permits a forging operation at a relatively high forging ratio, in other words, a forging operation in which the blank needs to be forged to a great extent for obtaining the roughly-shaped precursor shoe.

While the presently preferred embodiments of this invention have been described above, for illustrative purpose only, it is to be understood that the present invention is not limited to the details of the illustrated embodiments. For example, the principle of the invention is applicable to a shoe used for a swash plate type compressor equipped with a double-headed piston having head portions on the opposite sides of the engaging portion, or a shoe used for a swash plate type compressor of fixed capacity type. It is to be understood that the present invention may be embodied with various changes and improvements such as those described in the SUMMARY OF THE INVENTION, which may occur to those skilled in the art.

What is claimed is:

1. A method of producing a shoe for a swash plate type compressor, said shoe being disposed between a swash plate and a piston of said swash plate type compressor and formed of an aluminum alloy, the method comprising:

a main forging step of forging a blank for producing said shoe into a roughly-shaped precursor shoe;

a thermal refining step of thermally refining said roughly-shaped precursor shoe; and a size-adjustment forging step of forging said roughly-shaped precursor shoe which has been thermally refined, into a size-adjusted shoe.

2. A method according to claim 1, wherein said main forging step comprises a plurality of sub-forging steps.

3. A method according to claim 2, further comprising an annealing step effected following at least one of said plurality of sub-forging steps except a last one of said plurality of sub-forging steps.

4. A method according to claim 2, wherein an annealing step is not effected between any successive two of said plurality of sub-forging steps.

5. A method according to claim 2, wherein said plurality of sub-forging steps consist of a first sub-forging step which is effected on said blank for obtaining an intermediate shoe whose similarity in configuration to said size-adjusted shoe is lower than said roughly-shaped precursor shoe, and a second sub-forging step which is effected on said intermediate shoe for obtaining said roughly-shaped precursor shoe.

6. A method according to claim 5, further comprising an annealing step effected between said first and said second sub-forging steps for annealing said intermediate shoe.

7. A method according to claim 5, wherein an annealing step is not effected between said first and said second sub-forging steps.

8. A method according to claim 1, further comprising a size-adjustment grinding step effected on said size-adjusted shoe obtained after said size-adjustment forging step.

9. A method according to claim 1, wherein a size-adjustment grinding step is not effected on said size-adjusted shoe obtained after said size-adjustment forging step.

10. A method according to claim 1, further comprising a partial-forming step effected on a part of said blank prior to said main forging step.

11. A method according to claim 1, wherein said shoe for said swash plate type compressor includes a flat portion having a generally flat surface to be held in sliding contact with said swash plate, and a part-spherical portion having a generally part-spherical surface to be held in sliding contact with said piston.

12. A method according to claim 10, wherein said shoe for said swash plate type compressor includes a flat potion having a generally annular flat surface which is formed with a recess at a substantially central portion thereof and which is to be held in sliding contact with said swash plate, and a part-spherical portion having a generally part-spherical surface to be held in sliding contact with said piston, said recess being formed in said partial-forming step.

13. A method according to claim 1, wherein each of said main forging step and said size-adjustment forging step is effected by cold forging.

14. A method according to claim 1, wherein said thermal refining step effected on said roughly-shaped precursor shoe comprises: a step of effecting a solution heat treatment; and a step of effecting an artificial age hardening treatment after said step of effecting said solution heat treatment.

15. A method according to claim 1, wherein said thermal refining step effected on said roughly-shaped precursor shoe comprises: a step of effecting a solution heat treatment; and a step of effecting an over-aging treatment which is effected beyond conditions of an artificial age hardening treatment at which the maximum strength is obtained and which is effected after said step of effecting said solution heat treatment.

* * * * *